United States Patent [19]

Sparkjaer

[11] Patent Number: 4,850,021

[45] Date of Patent: Jul. 18, 1989

[54] METHOD AND A CIRCUIT FOR DECODING FOUR CHANNEL SIGNALS WHICH ARE CODED IN A MATRIX AND AVAILABLE IN THE FORM OF A TWO-CHANNEL SIGNAL

[76] Inventor: Ole Sparkjaer, Nydamsvej 17, 3200 Helsinge, Denmark

[21] Appl. No.: 90,978

[22] PCT Filed: Dec. 4, 1986

[86] PCT No.: PCT/DK86/00131

§ 371 Date: Aug. 4, 1987

§ 102(e) Date: Aug. 4, 1987

[87] PCT Pub. No.: WO87/03771

PCT Pub. Date: Jun. 18, 1987

[30] Foreign Application Priority Data

Dec. 6, 1985 [DK] Denmark ..... 5674/85

[51] Int. Cl.[4] ..... H04S 3/00

[52] U.S. Cl. ..... 381/22

[58] Field of Search ..... 381/18, 19, 20, 21, 381/22, 23, 106

[56] References Cited

U.S. PATENT DOCUMENTS 4,024,344 5/1977 Dolby et al. ..... 179/1 G
4,612,663 9/1986 Holbrook et al. ..... 381/24

FOREIGN PATENT DOCUMENTS 2203250 5/1974 France .
1384610 2/1975 United Kingdom .
1522135 8/1978 United Kingdom .
2006583 5/1979 United Kingdom .

*Primary Examiner*—Forester W. Isen
*Attorney, Agent, or Firm*—Steinberg & Raskin

[57] ABSTRACT

By a method and a circuit for the purpose of decoding four-channel signals coded in a matrix and available in the form of a two-channel signal, whereby in each channel an automatic control of the amplification will take place by means of an output amplifier (ΔL, ΔR, ΔB, ΔC) in the output stage in question, it is proposed that the differential signal is conducted both to a delay circuit (ΔT) and then to an expander circuit (EXP), and also to a central rectifier element (D1), that the output signal ($U_{CD}$) form the rectifier circuit (D1, $C_A$, $C_D$) is both conducted to the expander circuit (EXP) and applied for controlling the channels in pairs, whereby the stereo channels are controlled in phase and the center and background channels in reversed phase of the mean value ($U_{CD}$) of the differential signal, and that all channels moreover adjusted both in phase to the DC component of the summation signal amplitude and also in accordance with a level chosen in advance.

13 Claims, 3 Drawing Sheets

METHOD AND A CIRCUIT FOR DECODING FOUR CHANNEL SIGNALS WHICH ARE CODED IN A MATRIX AND AVAILABLE IN THE FORM OF A TWO-CHANNEL SIGNAL

BACKGROUND OF THE INVENTION

The subject of the invention is a method and a circuit for the purpose, for instance on sound films, of decoding four channel signals, i.e. the right, left, centre and background, which are coded in a matrix and are available in the form of a two-channel signal, by the application of amplifiers for the right and left channels respectively, and a summation applifier forming the sum of the right and left stereo channels, for the centre channel, and a differential amplifier forming the difference between the right and left stereo channels, for the background channel, whereby in each channel an automatic control of the amplification will take place by means of an output amplifier in the output stage in question.

On sound films for stereo reproduction of the sound the two optical sound tracks are placed between the frame field and the perforation, which ensures the synchronised transport of the films. On these sound tracks the right and left channels are recorded directly, and on top of these channels a mono signal such as the dialogue is recorded with equal amounts of information on both tracks. Effect sounds, such as pistol shots or screeching car tyres, are always recorded in stereo. FIG. 1 shows a representation of a known system for the type referred to above, such as it is known. To obtain a greater stereo effect, a controllable amplifier has been inserted into each of the four channels. This one increases the amplification when the voltage over the capacitor C increases. In some cases D and C are replaced by a phase detector, which measures the phase difference between the various channels and adjusts accordingly. However, these systems all have the drawback that noise impulses, for instance in the right channel, which—on a sound film—is most approximate to the perforation of the film, and which is thus most exposed to scratches and dirt, will cause an upwards adjustment of the right channel, whereby the centre channel will be adjusted half as much upwards, and an upwards adjustment of the background channel, as this one is constantly affected by the difference between the right and left channels. This will cause a total displacement of the stero picture and is thus an illusion-spoiling drawback.

A circuit for the production of three channel signals is known from DE patent specification No. 25.51.326, in which the centre channel is adjusted out of phase of the adjustment of the stereo channels right and left, and in which delay devices in the stereo channels are to ensure than the sound from the stereo channels does not reach the listener before the sound from the centre channel reaches him. Such an out of phase adjustment is inexpedient as, in case of small or no amplitudes on the sound tracks, the amplification will be increased to maximum either in the centre channel, because the stereo channels are adjusted totally down, or in the stereo channels, because the centre channel is adjusted totally down. This will obviously give a deteriorated signal-to-noise-ratio.

SUMMARY OF THE INVENTION

It is the task of this present invention to provide a method and a circuit of the type referred to initially, so that a simple circuit will constantly ensure a stable stereo sound picture with an optimal signal to noise ratio under the given conditions.

This task is solved, according to the invention, in the way that the differential signal, which is produced as the difference between the right and left stereo channels, is conducted both to a delay circuit and then to an input terminal of an expander circuit, and also, preferably through a filtration network, to a central rectifier element, that the output signal from the rectifier circuit is both conducted to another input terminal of the expander circuit and is also applied for controlling the channels in pairs, whereby the stereo channels are controlled in phase and the centre and background channels in reversed phase to the mean value of the differential signal, and that all channels moreover, by means of e.g. the DC component in the output voltage of the summation amplifier, which is produced as the sum of the right and left stereo channels, and/or another set point means, such as a potentiometer, are adjusted both in phase to the DC component of the summation signal amplitude, and also in accordance with a level chosen in advance.

A circuit for performing the method, according to the invention, for deriving four channel signals from a recorded stereo signal, i.e. the right, left, centre and background, consisting of amplifiers for the right and left channels respectively, and a summation amplifier forming the sum of the right and left stereo channels, for the centre channel, and a differential amplifier forming the difference between the right and left stereo channels, for the background channel, whereby each output amplifier automatically will control the amplification of the output stage in question, is characterised by that the output terminal from the differential amplifier is connected through a filtration network to a central rectifier element, whose input terminal is both connected to an inverting amplifier and also to the control input terminal of an expander circuit for the background channel, and that the output terminal from the differential amplifier is connected to a delay circuit, whose output terminal is connected to the expander for the background channel, and that the output terminal from the inverting amplifier is both connected, via a resistor, to the control input terminals for the output stages of the centre and background channels, and also to the input terminals of a further inverting amplifier, whose output is connected, via a resistor, to the control input terminals of the output stages for the stereo channels, and that the output terminal from the summation amplifier is connected via a low-pass filter to a non-inverting input terminal of a DC amplifier, whose inverting input terminal is connected to a potentiometer serving as volume control, and whose output terminal is connected, via a resistor, to the control input terminals of the output stages for the centre and background channels and, via a resistor, is connected to the control input terminals of the output stages for the stereo channels.

With the method and the circuit of the invention a number of advantages are achieved, which either cannot, or can only with the application of heavy resources, be provided with circuits already known. Thus obvious quality improvements may be obtained at the same time as both financial resources and mounting work are saved by:

(a) application of a central rectifier for the control of all four channels, where so far separate rectifiers have been used in each channel, (b) application of a single volume control acting on all four output stages, instead of four separate volume controls, (c) placement of the delay circuit before the expansion, which will reduce the noise from the delay circuit, and in that:

(d) the differential amplifier detects and amplifiers the difference between the right and left stereo channels, which difference is carried on as the background signal and after rectification is used as control voltage both for the reversed phase control of the centre and background channels and for the in-phase control of the stereo channels and the summation amplifier detects and aplifies the sum of the right and left stereo channels, which sum is carried on as the centre signal and after rectification it is used as control voltage for simultaneous in-phase control of all channels, (e) the rectifier is only supplied with frequencies in the frequencies band covering speech communication, e.g. the frequency range from 100 Hz to 8 kHz, which has the result that minor phase differences and noise impulses will not affect the adjustment, (f) the values of the resistors in the differential-signal controlled branch of the government are far bigger than the values of the resistors of hte sum-signal controlled control branch, preferably an order of magnitude of ten, whereby an undesired cross-control with mutual off-set is avoided, (g) the rectifier has two capacitors, the attack capacitor, which connects the rectifier to the reference potential ensuring a sufficiently rapid impulse response, and the decay capacitor, which is designed to keep the level of the output signal for a period that makes control possible, and which is also of such duration that there will be no frequent, unintended control interferences, and these two capacitors have different capacitances, where the capacitance of the attack capacitor is substantially smaller than the capacitance of the decay capacitor, mainly an order to magnitude of ten, whereby any ripple on the control voltage is reduced, (h) the circuit will automatically effect the conversion from mono to stereo reproduction, whereas this conversion may also be obtained by the operation of a single switch, which couples the input for the rectifier circuit to the reference potential, (k) the voltage for the rectifier is taken out before the delay circuit, thereby obtaining that the amplifier for the background channel is adjusted upwards before the signal passes through the delay circuit, i.e. that transients are also reproduced at the correct amplitude. A reasonable delay may be of e.g. the same duration as the time constant of the rectifier circuit, which is formed by the product between the decay capacitor and an inherent resistance in the rectifier circuit.

By having the stereo channels controlled by the same voltage it is ensured that the stereo picture does not flounder in case of noise impulses in e.g. one channel, and by using the DC component in the output voltage of the summation amplifier for simultaneous adjustment of all four channels, the result will be an improved signal to noise ratio, and at the same time the drawbacks of the present reversed phase control between the centre channel and the stereo channels are prevented, as the DC component will rise at a rising signal level in the recording technique that is known under the disignation of "Noiseless Recording" , which will be explained later. A further advantage in using the DC component for controlling is that the sound track will open just before the modulation begins, which means that the adjustment has taken place, when the sound is to be reproduced. This characteristic would otherwise require a complicated rectifier with delay circuits in order to obtain the same effect as is now provided by means of a capacitor and a resistor and a simple DC amplifier.

BRIEF DESCRIPTION OF THE DRAWINGS

The invention is explained in the following by means of an execution example shown on the drawing. The drawing shows, in.

DESCRIPTION OF THE PREFERRED EMBODIMENTS

Figure 1:
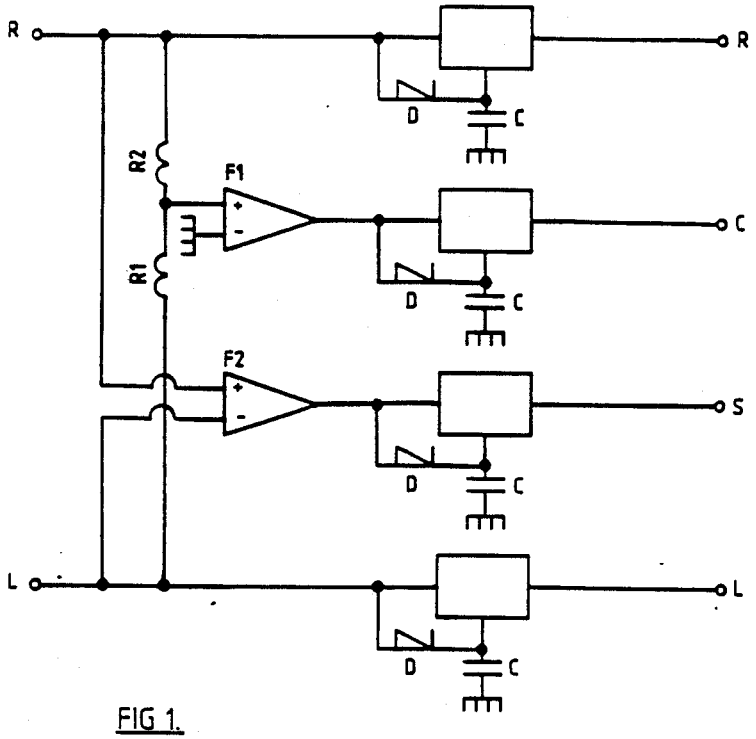
FIG. 1 a schematic representation of a circuit such as it is basically known, FIG. 2 a schematic representation of a circuit according to the invention, also with schematic representations of voltage courses in the essential junctions, FIG. 3 the voltage course of the background channel in big amplifications, where the inverting amplifier is excited so much that it "saturates", FIGS. 4A and 4B an outline representation of a sound track to explain the concept of "Noiseless Recording".
Figure 2:
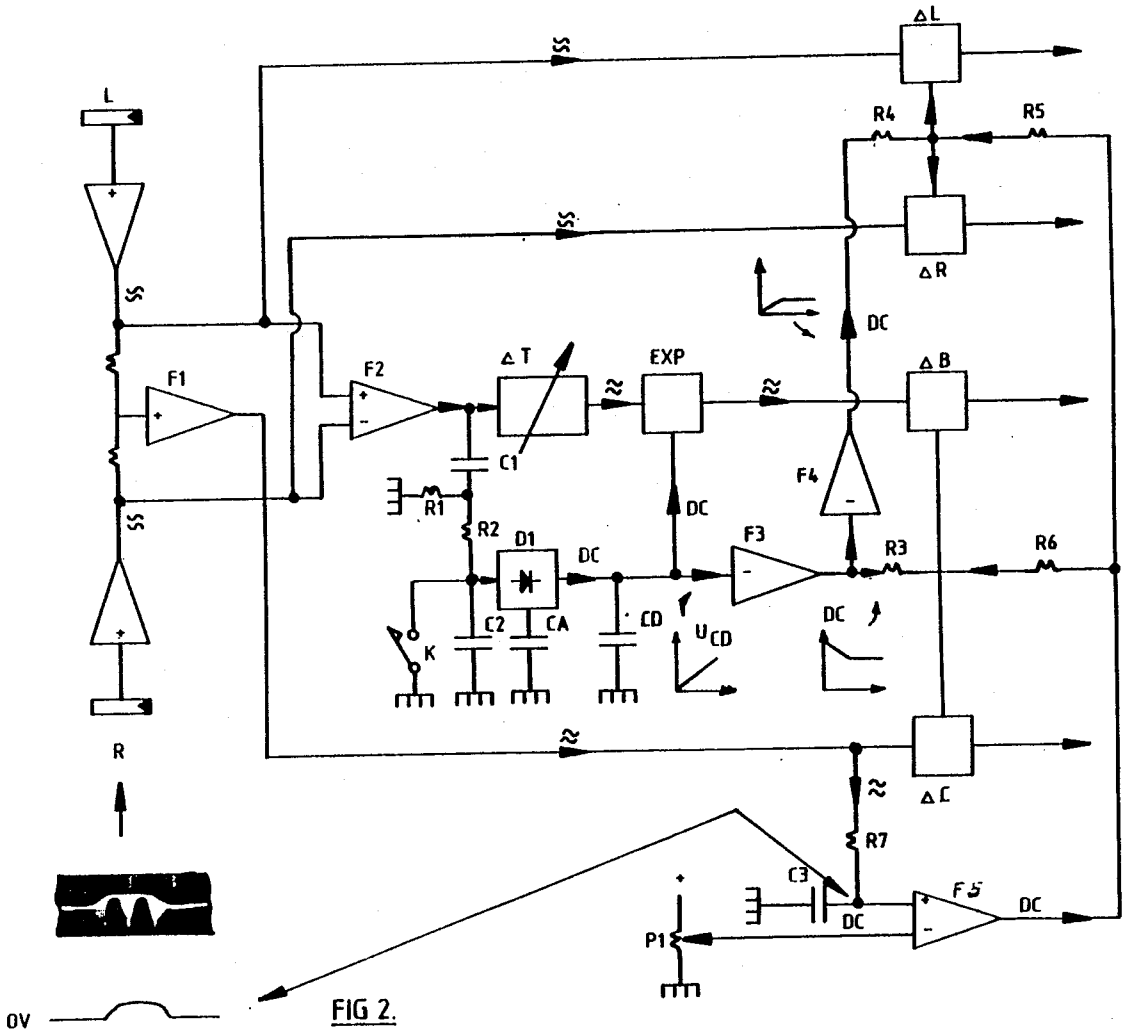

FIG. 2 shows a circuit according to the invention, in which the sound tracks, the photocells and the preamplifiers are schematically indicated. From these two signal sources, the amplifiers F1 and F2 form the sum and the difference, respectively, between the two tracks. The stereo channels are, before the amplifiers, carried out to the respective controllable stereo output stages. The output signal from the amplifier F1 is carried direct to the output stage ΔC for the centre channel, where a branching from its input terminal is carried via a low-pass filter consisting of the capacitor C3 and and the resistor R7, to the DC amplifier F5, and via the resistors R5 will adjust the output stages ΔL, ΔR for the stereo channels, and the output stages ΔC and ΔB for the centre and background channels concurrently with the DC component in a sound signal in the sound tracks. With this adjustment the signal to noise ratio will increase.

The output signal from the differential amplifier F2, which amplifies the difference between the two sound tracks, is conducted to the delay circuit ΔT, which is inserted to ensure that the sound from the front loudspeakers will reach the listener a little before the sound from the background loudspeakers reaches him. From the delay circuit ΔT the signal is carried on to an expander circuit EXP, which is controlled by the output voltage from the diode D1, which rectifies the band-pass filtered output signal from the amplifier F2. This band-pass filtration will, by means of the capacitor C1 and the resistor R1, cut off low frequencies, and by means of the capacitor C2 and the resistor R2 it cuts off high frequencies, such as noise. The signal is rectified will now form the control voltage $U_{CD}$ for the entire system. The attack capacitor $C_A$ will together with an inherent resistance $R_A$ give a small time constant (attack time), which provides a transient protection, but also introduces a low-frequency ripple voltage. This ripple voltage may be reduced by the application of the capacitor $C_D$, which, together with an inherent resistance $R_D$, give a long recovery time, which stretches over considerably longer time than the time constant $C_A \times R_A$. The control voltage $U_{CD}$ will be conducted both to the control input terminal for the expander circuit EXP, whose input signal is amplified proportionally to this control voltage as:

$$\frac{V_{ud}}{V_{ind}} = \frac{2}{I_i} \cdot \frac{R_o \cdot V_{ind}(\mathrm{AVG})}{R_a \cdot R_i} \quad (I_i = 140\ \mu A), \tag{1}$$

where $R_i$, $R_A$ and $R_O$ are the input, attack and output resistance, respectively, and where $I_i$ is the input current and $V_{ind}$(AVG) is the rectified mean value of the input voltage, and also to the DC amplifier F3, which inverts the phase of the control signal and "saturates" app. 6 dB before the maximum input signal level. The output signal from the DC amplifier F3 is conducted via the resistor R3 to the control input terminal of the compressor circuit ΔB for the background signal. This output stage attenuates the output signal from the expander EXP, proportionally to the output voltage level from the DC amplifier raised to the power of ½, as:

$$\frac{V_{ud}}{V_{ind}} = \left\{ \frac{I_i}{2} \cdot \frac{R_a \cdot R_t}{R_i \cdot V_{ind}(\mathrm{AVG})} \right\}^{-\frac{1}{2}} \tag{2}$$

where $R_i$, $R_a$ and $R_t$ are the input, attack and feed-back resistances, respectively, and where $I_i$ is the input current for the feed-back branch, and $V_{ind}$(AVG) is the rectified means value of the input voltage, so that the background channel is adjusted totally by an expansion and a compression. In the expander/compressor circuit EXP, ΔB the output signal may be provided with a bias in the form of a DC component, whose size depends of an number of non-specified resistances. By this design of the amplification of the background channel, the amplification above a certain level, e.g. −6 dB, will be proportional to the input signal level of the background channel, which means that the signal level expressed in decibels will double.

Figure 3:
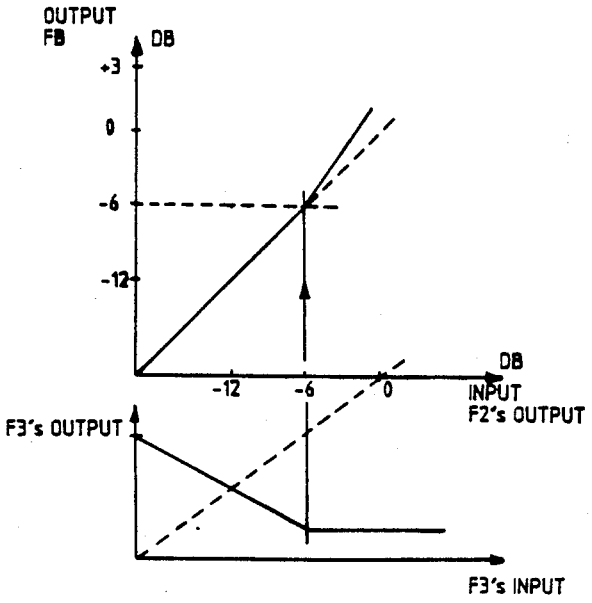

For a further illustration of the signal levels of the background channel, see FIG. 3, which shows the amplification of the background channel such as it is totally controlled by the expander/compressor circuits EXP, ΔB by means of the output signal $U_{CD}$ from the diode D1. In case of a rising amplitude the input voltage to the amplifier F3 the output voltage will fall down to a level being app. 6 dB below the maximum excitation. Hereafter a saturation will occur in the amplifier F3, so that a further reduction of the control voltage is impossible. This will have the result that the compressor circuit can no longer affect the signal, and therefore the output of the expander EXP, above this signal level, will only be attenuated at a constant factor. The amplification of the expander/compressor circuits as a whole are presented on the top curve of FIG. 3.

Moreover, FIG. 2 shows that the output signal from the amplifier F3 will equally be carried to the input terminal of a further inverting DC amplifier F4, which ensures that the stereo channels are controlled reversely to the centre channel. This control method is practical with the circuit of the invention, as it is ensured in a way that will be described below, that all outputs are reduced when there is no signal on the sound tracks. Thereby one or more of the output terminals making noise is suitably avoided, when there is no signal source. The control signal for this control is provided in the way that the output signal from the summation amplifier F1 is low-pass filtered at a low upper limiting frequency, so that it is essentially the DC component of the sum signal that is applied for the control. This DC component is conducted to the non-inverting input terminal of the DC amplifier F5, whose inverting input terminal is connected to a potentiometer P1 that serves as a volume control, and whose output is connected via a resistor R6, both to the control input terminals of the output stages ΔC, ΔB for the centre and background channels and also to the control input terminals for the output stages, ΔL, ΔR for the stereo channels. Hereby a volume control is suitably provided for all channels by means of only one potentiometer.

Figure 4A:
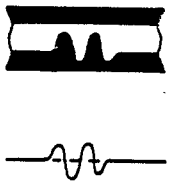
Figure 4B:
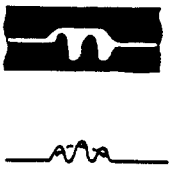

The reason that the DC component may be applied for adjustment purposes is the technique which was introduced already in 1920, under the designation of "Noiseless Recording", NR. FIG. 4A shows a schematic representation of a sound track of a sound film, recorded without any NR. The photocells will on average receive a constant light amount wherefore the DC component will always be close to nil. Because of static electricity etc. there will always be dust grains deposited on films, which is of no special importance in the dark coloured areas. The exposed area, where the light penetrates, will however be affected by the dust particles deposited, as these will unsuitably affect the sound as noise. To avoid this drawback it was proposed to narrow the sound track in sound breaks during the recording to that only a small amount of light was transformed to the photocells, when there were no sound signals in the sound tracks. A schematic representation of a sound track with NR is shown in FIG. 4B. It shows that the width of the sound track is heavily reduced during sound breaks, and that the width is increased to normal a short time before the sound break is ended. This change of the width has the result that the amount of light which the photocells receive on average is not constant, and therefore the output signal from the photocells during sound reproduction will comprise a DC component, and according to the invention, this will suitably by applied for the adjustment of the level of the power amplifiers.

The components C1, R1, C2, and R2 of the filtration network are dimensioned so that only frequencies in the speech range (100 Hz–8 kHz) are passed through to the rectifier circuit. The values of the resistors R3 and R4 are far larger than the values of the resistors R5, R6, preferably on the order of magnitude of ten. Capacitance of the capacitor CA is substantially smaller than the capacitance of the capacitor CD in the rectifier circuit with the central rectifier element D1, preferably on the order of magnitude of ten. An input terminal of the rectifier element D1 is preferably connected to a switch K having a second connection which is linked to a reference potential. The delay circuit ΔT is inserted between the differential amplifier F2 and the expander circuit EXP. Voltage to the rectifier circuit D1, CA, CD is taken out before the delay circuit ΔT.

I claim:

1. A method for decoding four channel signals, i.e. right, left, centre and background, which are coded in a matrix and are available in the form of a two-channel signal comprising left and right channels, by the application to amplifiers of the right (R) and left (L) channels respectively, and to a summation amplifier (F1) forming the sum of the right and left channels, for the centre channel, and to a differential amplifier (F2) forming a difference between the right and left channels, for the background channel, whereby in each channel an automatic control of the amplification will take place by means of an output amplifier (ΔL, ΔR, ΔB, ΔC) in the output stage in question, comprising the steps of:

conducting the difference signal to an input terminal of an expander circuit (EXP) via a delay circuit, and to a central rectifier element (D1);

conducting an output signal ($U_{CD}$) from the rectifier element (D1) to another input terminal of said expander circuit (EXP) and applying said output signal ($U_{CD}$) for controlling the channels in pairs; and adjusting all channels by means of at least one of a DC component of an output voltage of the summation amplifier (F1) which is produced as the sum of the right and left channels and a set point means, both in phase according to the DC component of the summation signal amplitude, and also in accordance with a level chosen in advance.

2. A circuit for decoding four channel signals, i.e. right, left, centre and background, which are coded in a matrix and are available in the form of a two-channel signal comprising right and left channels, comprising amplifiers for the right (R) and left (L) channels respectively, and a summation amplifier (F1), which forms a sum of the right and left channels, for the centre channel, and a differential amplifier (F2) forming a difference between the right and left channels, for the background channel, whereby in each channel an automatic control of the amplification will take place by means of an output amplifier in the output stage in question, wherein an output terminal from the differential amplifier (F2) is connected through a filtration network (C1, R1, C2, R2) to a central rectifier element (D1) having an output terminal both connected to an inverting amplifier (F3) and also to a control input terminal of an expander circuit (EXP) for the background channel, the output terminal of the differential amplifier (F2) is connected to a delay circuit (ΔT) having an outuput terminal which is connected to the expander circuit (EXP) for the background channel, an output terminal from the inverting amplifier (F3) is both connected, via a resistor (R3), to control input terminals of output stages (ΔC, ΔB) for the centre and background channels and also to an input terminal of a further inverting amplifier (4) having an output terminal connected, via a resistor (R4), to control input terminals of output stages (ΔL, ΔR) for the right and left channels, and an output terminal of the summation amplifier (F1) is connected, via a low-pass filter (R7, C3), to a non-inverting input terminal of a DC amplifier (F5) having an inverting input terminal connected to a potentiometer (P1) serving as volume control and an output terminal connected, via a resistor (R6), to the control input terminals of the output stages (ΔC, ΔB) for the center and background channels and, via a resistor (R5), connected to the control input terminals of the output stages (ΔL, ΔR) of the right and left channels.

3. A circuit, according to claim 2, wherein the components (C1, R1, C2, R2) of the filtration network are dimensioned so that only frequencies in the speech range (100 Hz–8 kHz) are passed through to the rectifier circuit.

4. A circuit, according to claim 2, wherein the values of the resistors (R3, R4) are far larger than the values of the resistors (R5, R6).

5. A circuit, according to claim 2, wherein capacitance of a capacitor (CA) is substantially smaller than the capacitance of a capacitor (CD) in a rectifier circuit with the central rectifier element (D1).

6. A circuit, according to claim 2, wherein an input terminal of the rectifier element (D1) is connected to a switch (K) having a connection which is linked to a reference potential.

7. A circuit, according to claim 2, wherein the delay circuit (ΔT) is inserted between the differential amplifier (F2) and the expander circuit (EXP).

8. A circuit according to claim 2, wherein voltage to the rectifier element (D1) is taken out before the delay circuit (ΔT).

9. The circuit of claim 5, wherein the capacitance of capacitor (CA) is smaller by an order of magnitude of ten than the capacitance of the capacitor (CD).

10. The method of claim 1, comprising the additional step of coducting the difference signal through a filtration network (C1, R1, C2, R2) to the central rectifier element (D1).

11. The method of claim 1, wherein said set point means is a potentiometer (P1).

12. The method of claim 1, comprising the additional step of controlling the right and left channels in phase and the centre and background channels in reversed phase to a mean value of the output signal ($U_{CD}$).

13. The circuit of claim 4, wherein the values of the resistors (R3, R4) are larger by an order of magnitude of ten than the values of the resistors (R5, R6).

* * * * *